US006628078B2

(12) United States Patent
Inayoshi

(10) Patent No.: US 6,628,078 B2
(45) Date of Patent: Sep. 30, 2003

(54) DIELECTRIC BARRIER DISCHARGE LAMP AND DRY CLEANING DEVICE USING THE SAME

(75) Inventor: Sadatoshi Inayoshi, Kanagawa-ken (JP)

(73) Assignee: M.D.Com Inc. (JP)

( * ) Notice: Subject to any disclaimer, the term of this patent is extended or adjusted under 35 U.S.C. 154(b) by 446 days.

(21) Appl. No.: 09/750,740

(22) Filed: Dec. 29, 2000

(65) Prior Publication Data

US 2001/0022499 A1 Sep. 20, 2001

(30) Foreign Application Priority Data

Mar. 15, 2000 (JP) ..... 2000-072995

(51) Int. Cl.[7] ..... H01J 11/00

(52) U.S. Cl. ..... 313/607; 313/234; 313/634; 313/493

(58) Field of Search ..... 313/607, 35, 46, 313/234, 292, 238, 493, 355, 249, 634, 570, 571, 635, 601, 631, 618; 315/248

(56) References Cited

U.S. PATENT DOCUMENTS 5,444,331 A * 8/1995 Matsuno et al. ..... 313/553
5,510,158 A * 4/1996 Hiramoto et al. ..... 427/582
5,757,132 A * 5/1998 Matsuno et al. ..... 313/607
6,373,192 B1 * 4/2002 Morimoto et al. ..... 313/607
6,525,451 B1 * 2/2003 Hishinuma et al. ..... 313/234

FOREIGN PATENT DOCUMENTS

EP 1041602 A2 * 10/2000 ..... H01J/61/52
JP 7-196303 8/1995
JP 7-272693 10/1995

* cited by examiner

*Primary Examiner*—Jay Patidar
(74) *Attorney, Agent, or Firm*—Ostrolenk, Faber, Gerb & Soffen, LLP

(57) ABSTRACT

A dry cleaning device which uses a double-cylinder type dielectric barrier discharge lamp 10*a*, 10*b* as a ultraviolet source. An outside electrode 2 in a trough-like shape is tightly contacted with the outer tube 1*a* of a discharge container 1, reflecting the ultraviolet light and directs it toward a workpiece 40. A cover 3 covers the outside electrode 2 for insulation of the outside electrode 2 from the ozone. In the clearance between the outer tube 1*a* of the discharge container 1 and an $N_2$ introduction tube, an inside electrode 6 in a net-like shape is accommodated, nitrogen ($N_2$) gas is caused to flow through the clearance for cooling the lamp 10*a*, 10*b*.

13 Claims, 14 Drawing Sheets

DIELECTRIC BARRIER DISCHARGE LAMP AND DRY CLEANING DEVICE USING THE SAME

BACKGROUND OF THE INVENTION

1. Field of the Invention

The present invention relates to a double-cylinder type dielectric barrier discharge lamp and a dry cleaning device which uses a dielectric barrier discharge lamp as the ultraviolet light source, and particularly for dry cleaning device, relates to a dry cleaning device with which the organic substances adhering to the surface of a workpiece, such as a semiconductor wafer, are decomposed by projecting the ultraviolet light itself or exposing the workpiece to the ozone generated with the ultraviolet light.

2. Description of the Prior Art

The dry cleaning device with which ultraviolet light is projected onto a workpiece, such as a semiconductor wafer, or the workpiece is exposed to the ozone generated when the ultraviolet light permeates the air or gas oxygen, for decomposing and removing the organic substances adhering to the surface of the workpiece has been conventionally used in the semiconductor manufacturing process and the like. Some dry cleaning devices use not only either ultraviolet light or ozone, but also both ultraviolet light and ozone for promotion of decomposition of the organic substances.

As an ultraviolet light source for use with a dry cleaning device, a variety of discharge lamps, such as a mercury lamp, are widely known. Being a type of discharge lamp, the dielectric barrier discharge lamp which uses xenon as the principal component of the discharge gas radiates ultraviolet light having a wavelength as short as 172 nm. The ultraviolet light with a short wavelength has high power, being excellent in ability to decompose an organic substance, and thus can be advantageously used as cleaning power for a dry cleaning device, therefore, the dielectric barrier discharge lamp is excellent as the ultraviolet light source for a dry cleaning device.

The dielectric barrier discharge lamp is described in Japanese Unexamined Patent Publication No. 7(1995)-272693, for example. The cleaning device which uses a dielectric barrier discharge lamp as the ultraviolet light source is disclosed in Japanese Patent Publication No. 2705023, for example. In FIG. 11 in this Japanese Patent Publication No. 2705023, a tabular light source device is shown as the ultraviolet light source for a dry cleaning device. With the tabular light source device as shown in FIG. 11 in Japanese Patent Publication No. 2705023, double-cylinder type dielectric barrier discharge lamps (33*a,* 33*b,* 33*c*) are disposed side by side in the recess (4) of a lunch-box type metallic container (30) which also serve as a light reflecting plate. The metallic container (30) is of tabular type, one wide surface being provided as an open surface. The open surface is covered with a light taking-out window (31) made of a synthetic quartz glass plate. Into the recess (4) of the metallic container (30), nitrogen ($N_2$) gas is fed at a rate of a few liters per minute. In the air, ultraviolet light is contacted with oxygen, and converts it into ozone, therefore, by filling the recess (4) with nitrogen ($N_2$) gas in place of air, attenuation of the ultraviolet light and generation of ozone in the metallic container (30) are prevented. With this double-cylinder type dielectric barrier discharge lamp (33*a,* 33*b,* 33*c*), a net-like outside electrode (20*a,* 20*b,* 20*c*) is exposed, therefore, if ozone is generated in the recess (4), the outside electrode (20*a,* 20*b,* 20*c*) will be oxidized, and deteriorated, but by filling the recess (4) with nitrogen ($N_2$) gas, generation of ozone is prevented, and thus deterioration of the outside electrode (20*a,* 20*b,* 20*c*) is suppressed.

The tabular light source device as shown in FIG. 11 in the above-mentioned Japanese Patent Publication No. 2705023 is used as the ultraviolet light source (100) for the dry cleaning device as shown in FIG. 2 in the same Japanese Patent Publication or the like. With the dry cleaning device as shown in FIG. 2 in Japanese Patent Publication No. 2705023, the ultraviolet light source (100) and a substance to be treated (a substance from which the organic contamination adhering to the surface is removed, being oxidized by the ultraviolet light or ozone, i.e., a workpiece, which is here a slide glass (9)) are disposed in a treatment chamber (7). The ultraviolet light source (100) is held at a level of "d" above the top of the workpiece (9). Into the treatment chamber (7), a gas mixture of nitrogen ($N_2$) gas and oxygen ($O_2$) gas are supplied. The ultraviolet light radiated from the dielectric barrier discharge lamp permeates the nitrogen ($N_2$) gas in the ultraviolet light source (100), further permeates the quartz glass of the taking-out window in the ultraviolet light source (100), and permeates the gas mixture of nitrogen ($N_2$) gas and oxygen ($O_2$) gas in the treatment chamber (7), being projected onto the top of the workpiece (9). Ozone offers a strong oxidation action, thus is used in conjunction with the ultraviolet light for cleaning the workpiece (9).

In FIG. 7 in the above-mentioned Japanese Patent Publication No. 2705023, an example of double-cylinder type dielectric barrier discharge lamp is given in detail. The discharge lamp (18) in this double-cylinder type dielectric barrier discharge lamp is made of quartz glass, and is in the shape of a hollow cylinder, an inner tube (23) and an outer tube (24) being provided coaxially. A metallic electrode (20), which is the outside electrode, is provided on the outer surface of the outer tube (24), being formed in a net-like shape to allow permeation of the light. The outside electrode (20) is coated with an antioxidizing coating (22). An electrode (19), which is the inside electrode, comprises an aluminum film formed on the outer surface (the circumferential wall) of the inner tube (23), which also serves a reflection coating. The space between the inner tube (23) and the outer tube (24) provides a discharge space (21), which is filled with xenon as a discharge gas. The discharge container (18) has an overall length of 100 mm with the inner tube (23) having an outside diameter of 6 mm, and the outer tube (24) having an inside diameter of 8 mm.

FIG. 7 in Japanese Unexamined Patent Publication No. 7(1995)-272693 gives another example of dielectric barrier discharge lamp. The dielectric barrier discharge lamp as shown in FIG. 7 in Japanese Unexamined Patent Publication No. 7(1995)-272693 is called an aperture type one, having an outside electrode (8) made of aluminum which also serves as a light reflecting plate, being provided on a part of the circumferential surface of a discharge container (1). The region of the discharge container (1) which has no outside electrode provides a light taking-out window (9). The light taking-out window (9) extends in the longitudinal direction of the lamp, being formed in a slit-like shape.

To dissipate the heat generated in the dielectric barrier discharge lamp, air cooling by means of a fan and water cooling by passing the water through the cooling water tube provided inside of the discharge container.

However, providing a cooling fan or a cooling water supply device separately results in a complicated, large-sized, and expensive lamp device as an ultraviolet light source, making the maintenance cumbersome, and lowering the reliability.

A dielectric barrier discharge lamp must be provided with a means for preventing the electrode from being oxidized by the ozone generated by the ultraviolet light acting on the oxygen ($O_2$) gas. With the dielectric barrier discharge lamp as shown in FIG. 7 in the above-mentioned Japanese Patent Publication No. 2705023, the outside electrode (20) is coated with an anti-oxidizing coating (22). Further, with the tabular light source device as shown in FIG. 11 in the same Japanese Patent Publication, the dielectric barrier discharge lamp is housed in the chamber filled with nitrogen ($N_2$) gas. But, with the aperture type dielectric barrier discharge lamp as shown in FIG. 7 in Japanese Unexamined Patent Publication No. 7(1995)-272693, no means for prevention of electrode oxidation is shown.

To equip a dry cleaning device with a dielectric barrier discharge lamp, the cleaning chamber structure must be connected with the dielectric barrier discharge lamp for projecting the ultraviolet light into the cleaning chamber, and providing the above-mentioned cooling means and a means for prevention of electrode oxidation for the dielectric barrier discharge lamp tends to make the construction of the cleaning device as a whole intricate. However, no dielectric barrier discharge lamps which is simple in construction, while being provided with both cooling means and electrode oxidation prevention means have not been disclosed.

When the dielectric barrier discharge lamp as shown in FIG. 11 in the above-mentioned Japanese Patent Publication No. 2705023 is used as the ultraviolet light source (100) for the dry cleaning device as shown in FIG. 2 in Japanese Patent Publication No. 2705023, the media through which the ultraviolet light radiated from the lamp permeates before reaching the workpiece (9) act as follows: The ultraviolet light radiated from the dielectric barrier discharge lamp in the ultraviolet light source (100) permeates the nitrogen ($N_2$) gas in the ultraviolet light source (100), further permeates the quartz glass of the taking-out window in the ultraviolet light source (100), and permeates the gas mixture of nitrogen ($N_2$) gas and oxygen ($O_2$) gas in the treatment chamber (7), being projected onto the top of the workpiece (9). Thus, with this cleaning device, the ultraviolet light permeates both the gas mixture of nitrogen ($N_2$) gas and oxygen ($O_2$) gas and the quartz glass, which are different in index of refraction. In other words, the ultraviolet light permeating media are not uniform. Then, the ultraviolet light radiated from the dielectric barrier discharge lamp is partially reflected at the surface of the quartz glass window, and partially absorbed in the inside of the quartz glass window. The absorption factor of the inside of the quartz glass window varies depending upon the thickness t, and is approx. 5% when the thickness t is 1 mm, approx. 30% when the thickness t is 10 mm, and approx. 65% when the thickness t is 20 mm.

When the outside electrode of the double-cylinder type dielectric barrier discharge lamp is of net-like shape, being wound around the circumference of the discharge container, there occurs a loss according to the opening ratio, which is the ratio of the area of the hole portion of the net-like electrode to that of the metallic portion. The opening ratio loss ranges from a few percent to a few tens percent.

When the tabular light source device as shown in FIG. 11 in the above-mentioned Japanese Patent Publication No. 2705023 is used with the dry cleaning device, the dielectric barrier discharge lamp is housed in the chamber filled with nitrogen ($N_2$) gas, and therefore the electrode is not exposed to the ozone, which allows the electrode to be prevented from being oxidized, however, while the ultraviolet light radiated from the dielectric barrier discharge lamp reaches the light taking-out window (31) made of quartz glass, the ultraviolet light is diffused. Therefore, with the dry cleaning device which uses the tabular light source device as shown in FIG. 11 in the above-mentioned Japanese Patent Publication No. 2705023 as the ultraviolet light source, the ultraviolet light radiated from the dielectric barrier discharge lamp is attenuated before being projected onto the workpiece, compared to a dry cleaning device with which the dielectric barrier discharge lamp is directly faced to the cleaning chamber with the light taking-out window (31) made of quartz glass being removed.

To maintain the mechanical strength of the light taking-out window made of quartz glass, the quartz glass window must be thick in proportion to the area thereof. To increase the cleaning efficiency by cleaning a number of wafers at once, the area of the cleaning chamber must be widened, and in proportion to the area of the cleaning chamber, the area of the quartz glass window must be increased, which logically requires the thickness of the quartz glass window to be increased. With the increase in thickness of the quartz glass window, the absorption factor is increased, resulting in an increase in loss of the ultraviolet light. In addition, the quartz glass window is expensive, and yet, the permeability of light is decreased with the use, which means that it is an expendable item. Thus, an increase in area and thickness of the quartz glass window can be a great factor of increase in manufacturing cost of the dry cleaning device.

In addition, with the tabular light source device as shown in FIG. 11 in Japanese Patent Publication No. 2705023, the metallic container (30) for housing the dielectric barrier discharge lamp (33*a*, 33*b*, 33*c*) also serves as a light reflecting plate. With this dry cleaning device, the light reflecting structure must be large-sized, which prevents the cleaning device as a whole from being compact.

To solve the above-stated problems, the present invention offers the following means:

(1) A double-cylinder type dielectric barrier discharge lamp which has a double-cylinder type discharge container which seals the discharge gas, such as xenon gas, in the space between a transparent outside cylindrical tube and inside cylindrical tube; an outside electrode provided in the vicinity of the outside of the outside cylindrical tube; and an inside electrode which is coaxially disposed in the bore of the inside cylindrical tube; comprising:

a gas introduction tube which has an outside diameter smaller than the diameter of the bore of said inside cylindrical tube, providing a clearance between it and the bore, and is inserted into the bore;

an other-end-side end-structure which seals the opening of said bore on the other end side so that gas, such as, nitrogen gas which is introduced from the opening at one end of said gas introduction tube and discharged from the opening at the other end of the gas introduction tube is turned back on the other end side to be introduced into said clearance; and a cover which covers said outside electrode, and prevents the outside electrode from being exposed to the ozone generated by the ultraviolet light radiated from said discharge container;

wherein said outside electrode is formed in a trough-like shape, and is disposed with the inner surface being tightly contacted with the O.D. surface of said outside cylindrical tube, said inner surface forms a circular arc, such as a semicircle, in the plane orthogonalizing the axis of said outside cylindrical tube, and provides a mirror surface which reflects the light, said inside electrode is disposed in the clearance between said gas introduction tube and said inside cylindrical tube, being formed in a net-like shape which allows said gas to flow along the axial direction in the clearance, and said outside cylindrical tube provides a light taking-out window of said discharge container in the region corresponding to the aperture of said outside electrode.

(2) A dielectric barrier discharge lamp according to the above paragraph (1), wherein said cover is formed in the shape which forms a cooling gas space for passing gas between the cover and said outside electrode for cooling the outside electrode, an one-end-side end-structure which seals the opening of said bore on said one end side so that said gas discharged from said clearance on said one end side is introduced into said cooling gas space is provided, and a gap for discharging said gas passed through said cooling gas space is formed between the O.D. surface of said outside cylindrical tube or the outer surface of said outside electrode and said cover 3.

(3) A dielectric barrier discharge lamp according to the above paragraph (2), wherein said inner surface of said outside electrode forms a semicircle in the plane orthogonalizing the axis of the outside cylindrical tube, the sectional shape of said cover in the plane orthogonalizing said axis is of letter-Π, and said gap is formed between the edge along the direction of said axis of said outside electrode and the edge of the Π-shaped opening of said cover.

(4) A tabular light source device with which a plurality of dielectric barrier discharge lamps according to the above paragraphs (1) to (3) are tabularly arranged, wherein the axes of the plurality of dielectric barrier discharge lamps are parallel to one another, said light taking-out windows in the plurality of dielectric barrier discharge lamps are directed toward the same side, and the sides of said covers are contacted to one another or a spacer is interposed between covers.

(5) A dry cleaning device, having an ultraviolet light source which comprises a dielectric barrier discharge lamp according to the above paragraphs (1) to (3) or a tabular light source device according to the above paragraph (4), and a cleaning chamber structure for accommodating a workpiece, wherein, with said cleaning chamber structure, the workpiece is exposed to at least either of the ultraviolet light projected from said ultraviolet light source and the ozone generated by the ultraviolet light acting on the oxygen gas, and said ultraviolet light projected from said light taking-out window reaches said workpiece through a medium having a uniform index of refraction.

(6) A dry cleaning device according to the above paragraph (5), wherein, with said cleaning chamber structure, the cleaning surface of said workpiece is located at a distance as small as a few mm from said light taking-out window.

(7) A dry cleaning device, having an ultraviolet light source which comprises a tabular light source device, and a cleaning chamber structure for accommodating a workpiece, wherein, with said cleaning chamber structure, the workpiece is exposed to at least either of the ultraviolet light projected from said ultraviolet light source and the ozone generated by the ultraviolet light acting on the oxygen gas, said tabular light source device comprises a plurality of dielectric barrier discharge lamps according to the above paragraph (3) which are tabularly arranged side by side with the sides of said covers being contacted to one another or a spacer being interposed between covers, and said light taking-out windows in the plurality of dielectric barrier discharge lamps are directed toward the same side, said gap is opened into the cleaning chamber of said cleaning chamber structure, and said ultraviolet light projected from said light taking-out window reaches said workpiece through a medium having a uniform index of refraction.

(8) A dry cleaning device according to the above paragraph (7), wherein, with said cleaning chamber structure, the cleaning surface of said workpiece is located at a distance as small as a few mm from said light taking-out window.

SUMMARY OF THE INVENTION

One purpose of the present invention is to offer a dielectric barrier discharge lamp which is simple in construction while being provided with both cooling means and electrode oxidation prevention means, and can direct the ultraviolet light toward a definite direction with no need for a special construction for reflection of ultraviolet light. The other purpose of the present invention is to offer a dry cleaning device using a dielectric barrier discharge lamp as the ultraviolet light source with which the electrode of the dielectric barrier discharge lamp can be insulated from ozone without using an ultraviolet light taking-out window made of quartz glass.

Figure 1:
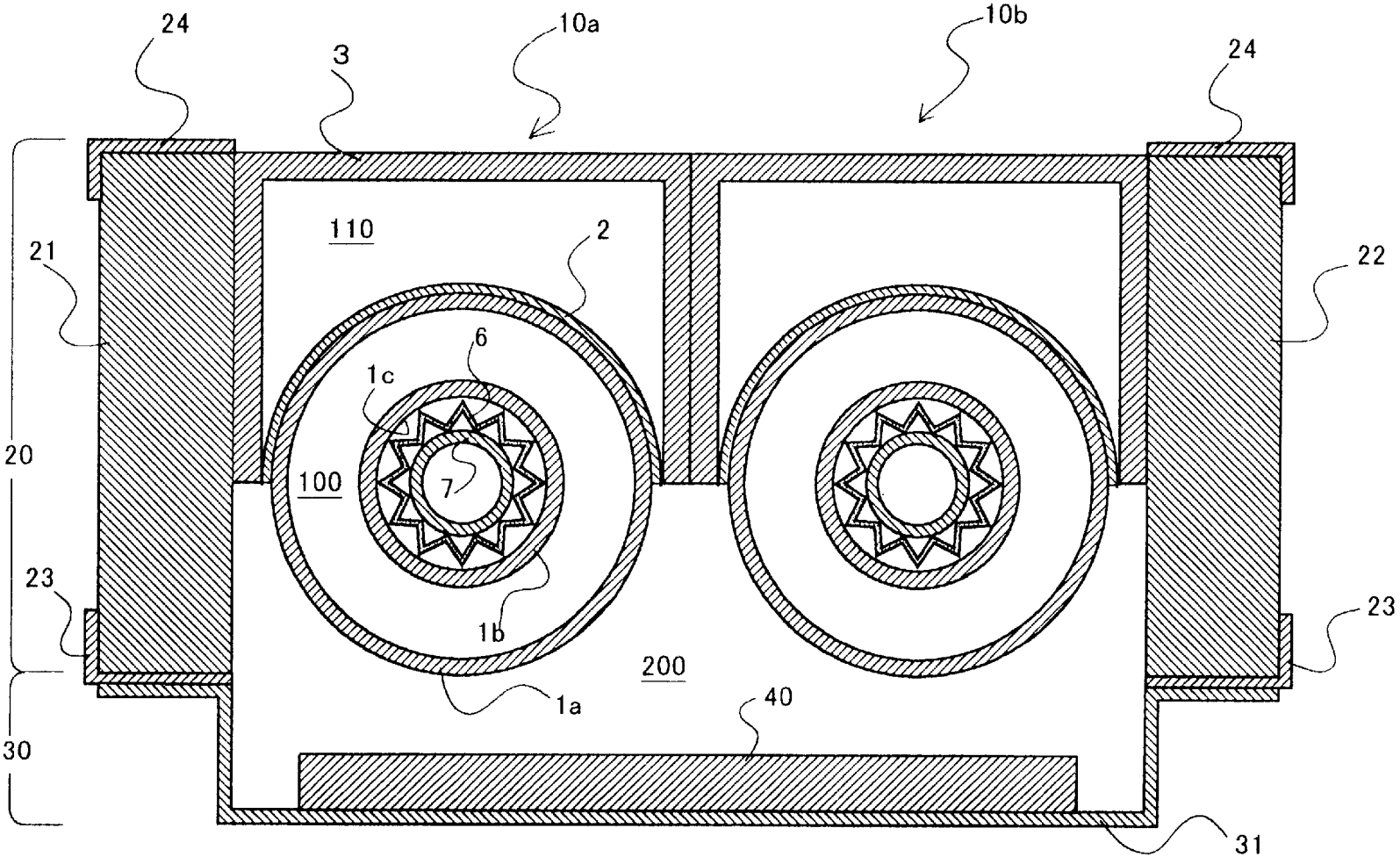
FIG. 1 is a cross sectional view illustrating a dry cleaning device which is an embodiment of the present invention.

1 Discharge container
1*a* Outer tube of discharge container 1
1*b* Inner tube of discharge container 1
1*c* Bore of inner tube 1*b*
2 Outside electrode
3 Cover
3*a* Threaded hole
4, 5 Lamp holder
4*a* $N_2$ passage in lamp holder 4
5*b* Female screw
6 Internal electrode
7 $N_2$ introduction tube
8 $N_2$ exhaust tube
9 Packing
10 Dielectric barrier discharge lamp
11 $N_2$ exhaust gap
20 Irradiation unit
21, 22 Side member in irradiation unit
23 Lower frame in irradiation unit
24 Upper frame in irradiation unit
30 Cleaning chamber structure
31 Base plate forming cleaning structure
41 Female screw
50 Tabular light source device formed by arranging five dielectric barrier discharge lamps flatly
51, 52 Spacer
60 Tabular light source device formed by arranging three dielectric barrier discharge lamps flatly
100 Discharge space
110 Outside electrode cooling gas space
200 Cleaning chamber

DESCRIPTION OF THE PREFERRED EMBODIMENTS

By giving embodiments of the present invention, the present invention will be explained more specifically.

Figure 2:
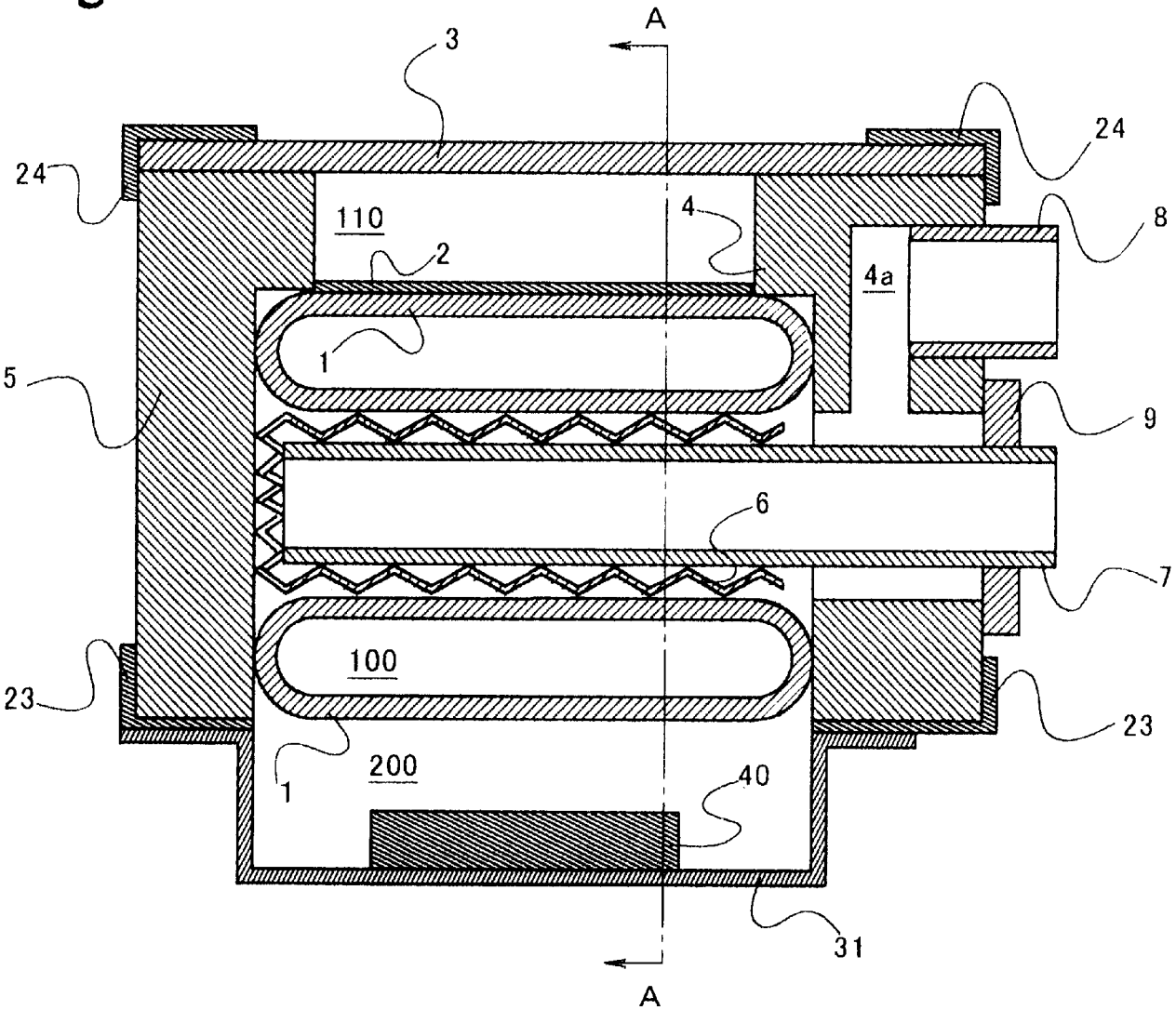
FIG. 2 is a longitudinal sectional view of a dry cleaning device as shown in FIG. 1.
Figure 3:
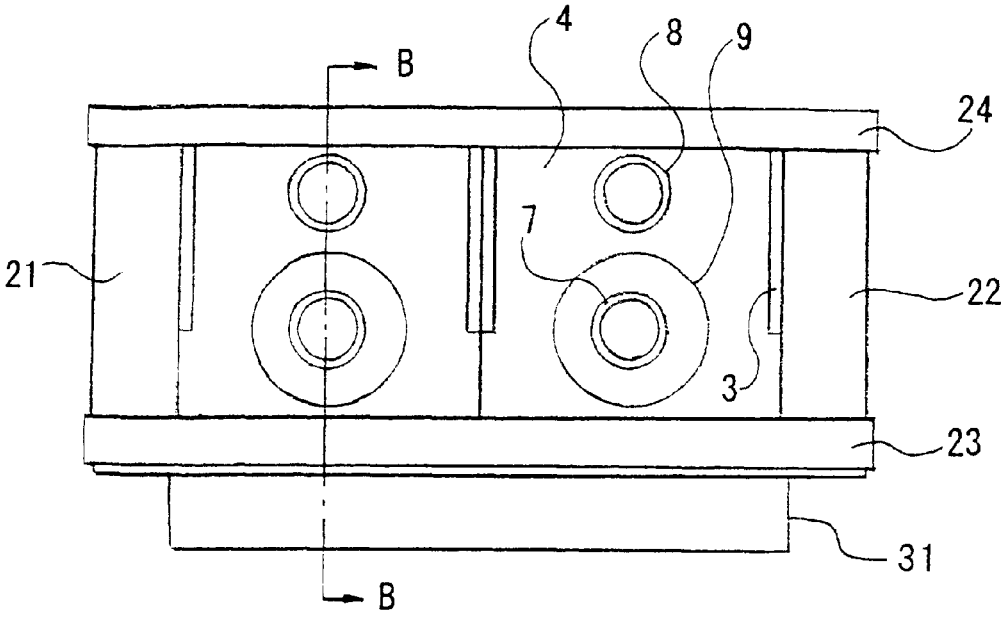
FIG. 3 is a side view of a dry cleaning device as shown in FIG. 1.
Figure 4:
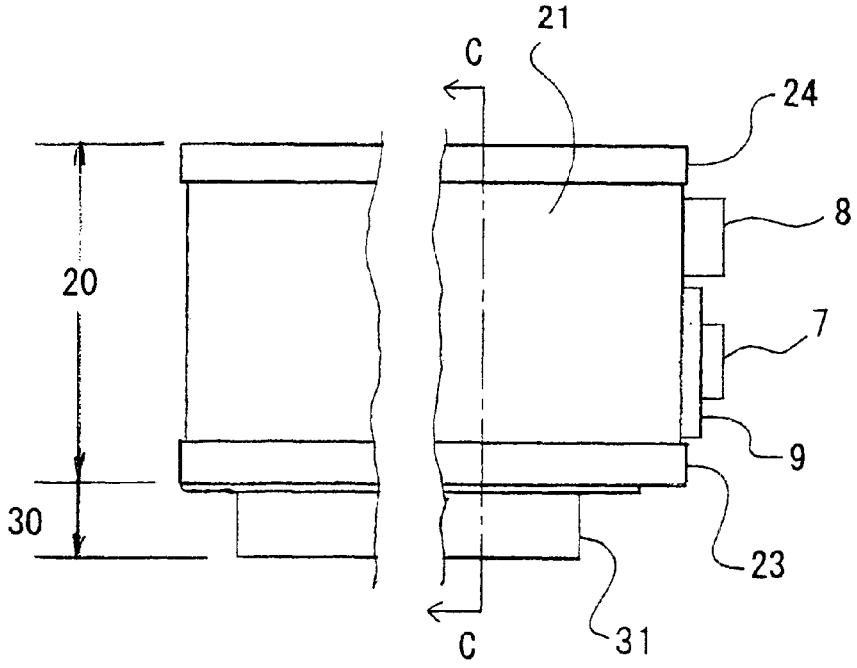
FIG. 4 is a front view of a dry cleaning device as shown in FIG. 1.

FIG. 1 is a cross sectional view illustrating a dry cleaning device which is an embodiment of the present invention. This FIG. 1 is a cross-sectional view taken along the line A—A of FIG. 2, and a cross-sectional view taken along the line C—C of FIG. 4. FIG. 2 is a longitudinal sectional view of a dry cleaning device as shown in FIG. 1. This longitudinal sectional view as shown in FIG. 2 is along the line B—B of FIG. 3, being a view taken in the direction of the arrows of FIG. 3. FIG. 3 is a side view of a dry cleaning device as shown in FIG. 1, and FIG. 4 is a front view thereof.

Figure 5:
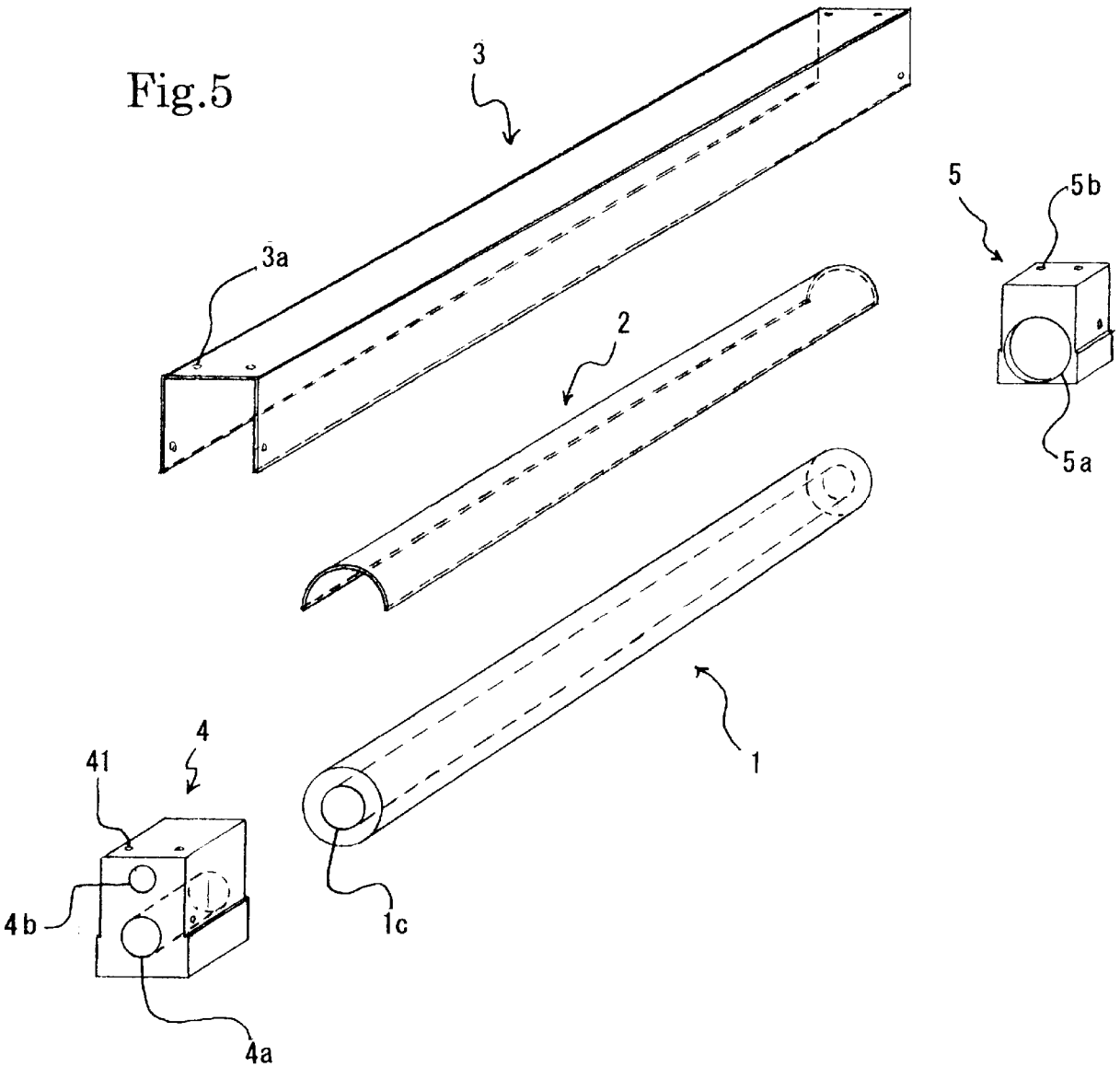
FIG. 5 is an exploded perspective side view of a dielectric barrier discharge lamp (FIG. 7) for use with a dry cleaning device of an embodiment as shown in FIG. 1.
Figure 6:
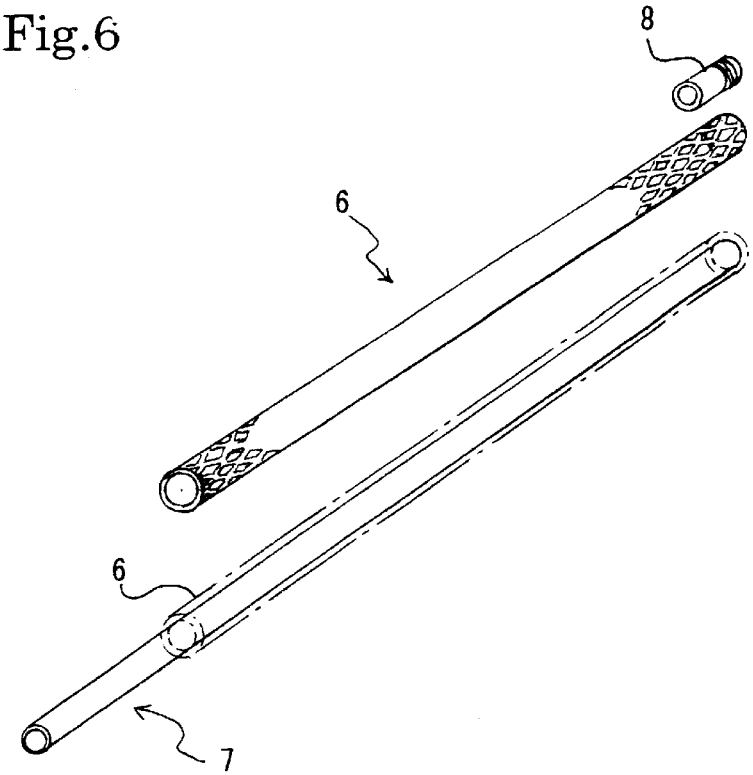
FIG. 6 is a perspective side view illustrating the members of a dielectric barrier discharge lamp as shown in FIG. 7.
Figure 7:
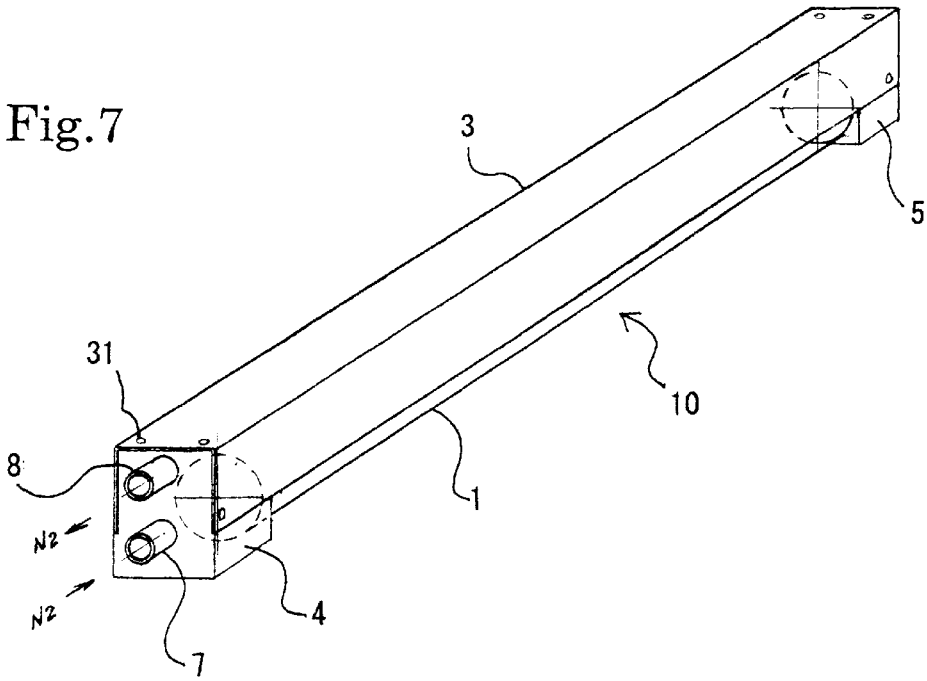
FIG. 7 is a perspective side view illustrating a dielectric barrier discharge lamp for use with a dry cleaning device of an embodiment as shown in FIG. 1.

FIG. 5 is an exploded perspective side view of a dielectric barrier discharge lamp for use with a dry cleaning device of an embodiment as shown in FIG. 1. FIG. 6 is a perspective side view illustrating the members of the dielectric barrier discharge lamp. FIG. 7 is a perspective side view illustrating the dielectric barrier discharge lamp.

FIG. 8(A) is a perspective side view of a tabular light source device formed by arranging five dielectric barrier discharge lamps side-by-side as shown in FIG. 7. FIG. 8(B) is a perspective side view of a tabular light source device formed by arranging three dielectric barrier discharge lamps side-by-side as shown in FIG. 7.

Figure 9:
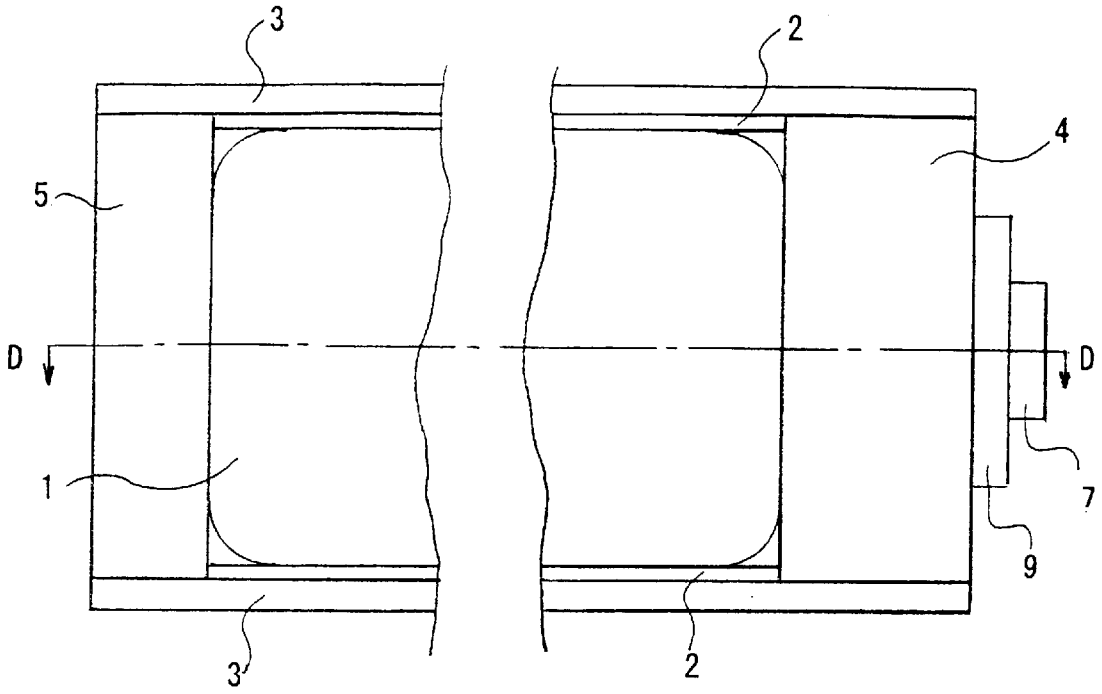
FIG. 9 is a bottom view of a dielectric barrier discharge lamp as shown in FIG. 7.
Figure 10:
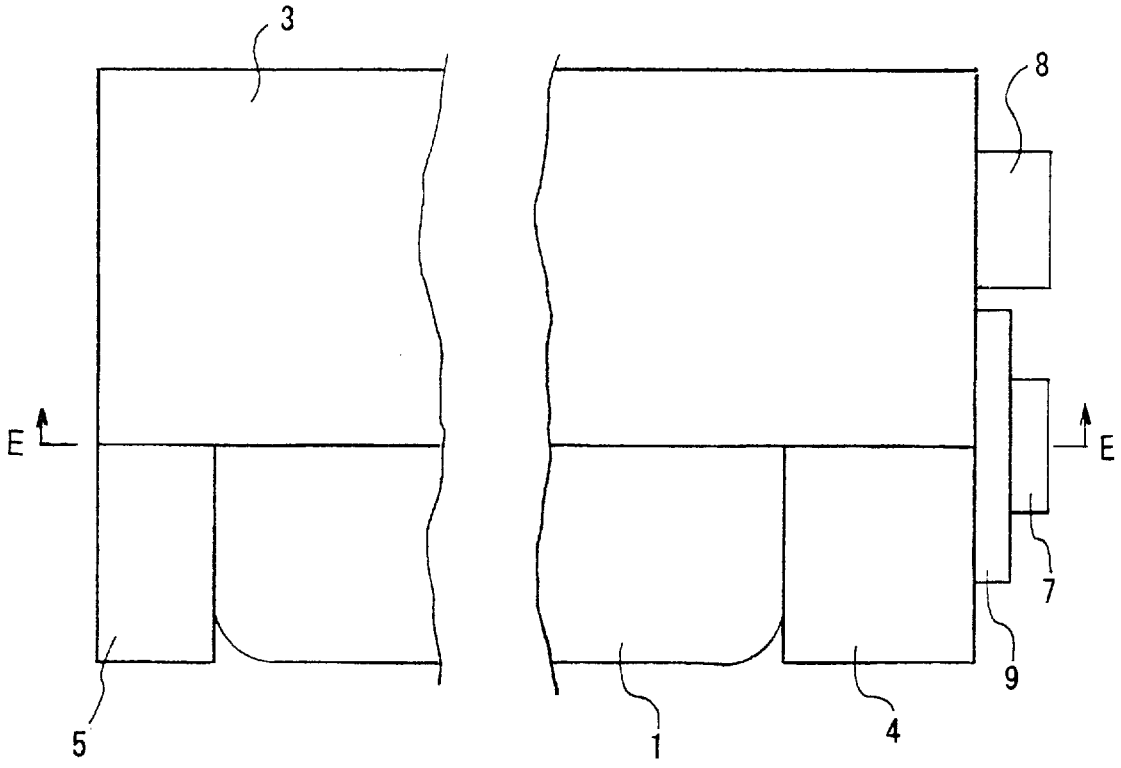
FIG. 10 is a front view of a dielectric barrier discharge lamp as shown in FIG. 9.
Figure 11:
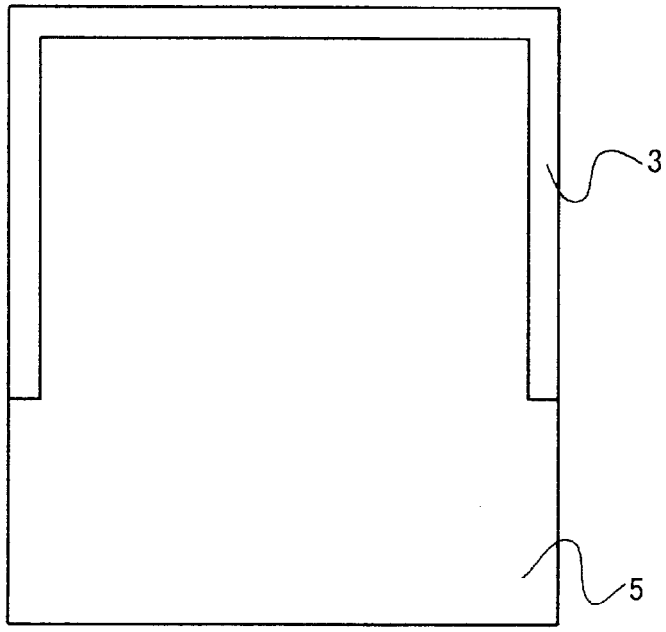
FIG. 11 is a left side view of a dielectric barrier discharge lamp as shown in FIG. 9.
Figure 12:
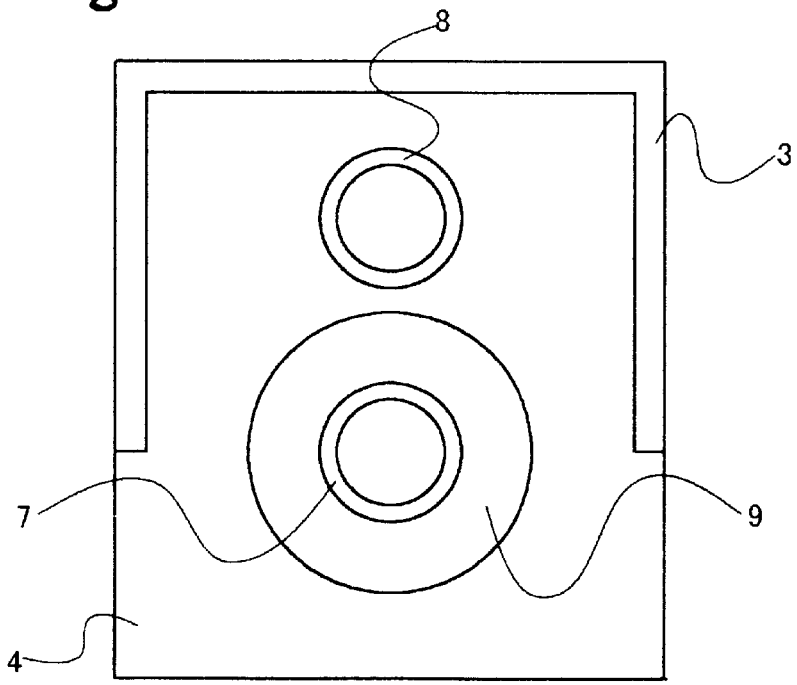
FIG. 12 is a right side view of a dielectric barrier discharge lamp as shown in FIG. 9.
Figure 13:
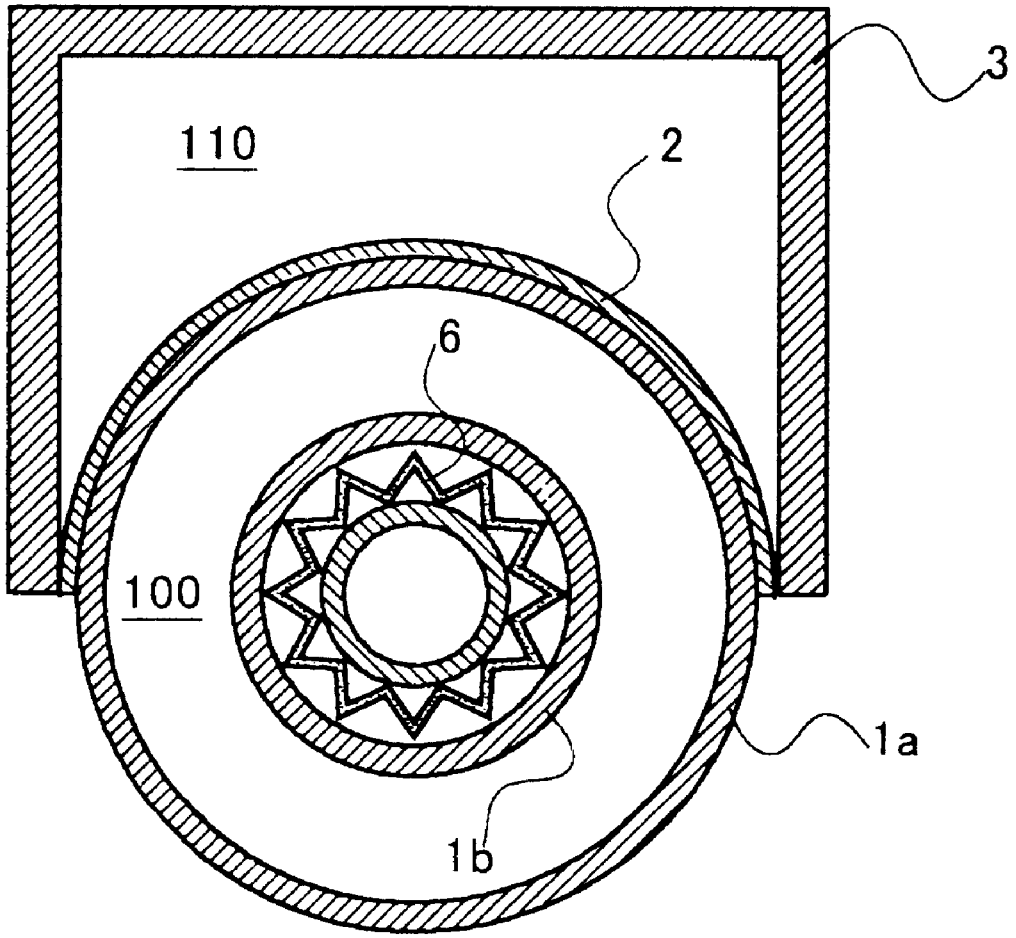
FIG. 13 is a cross-sectional view (a cross-sectional view taken along the line F—F of FIG. 15) of a dry cleaning device as shown in FIG. 9.
Figure 14:
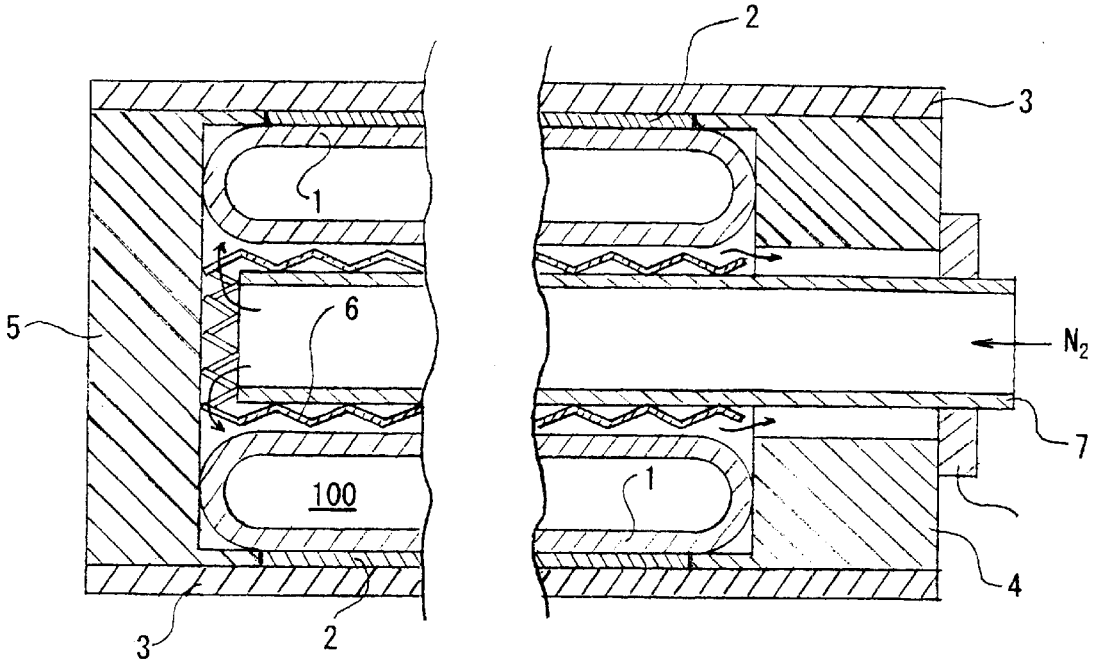
FIG. 14 is a longitudinal sectional view (a longitudinal-sectional view taken along the line E—E of FIG. 10) of a dielectric barrier discharge lamp as shown in FIG. 9.
Figure 15:
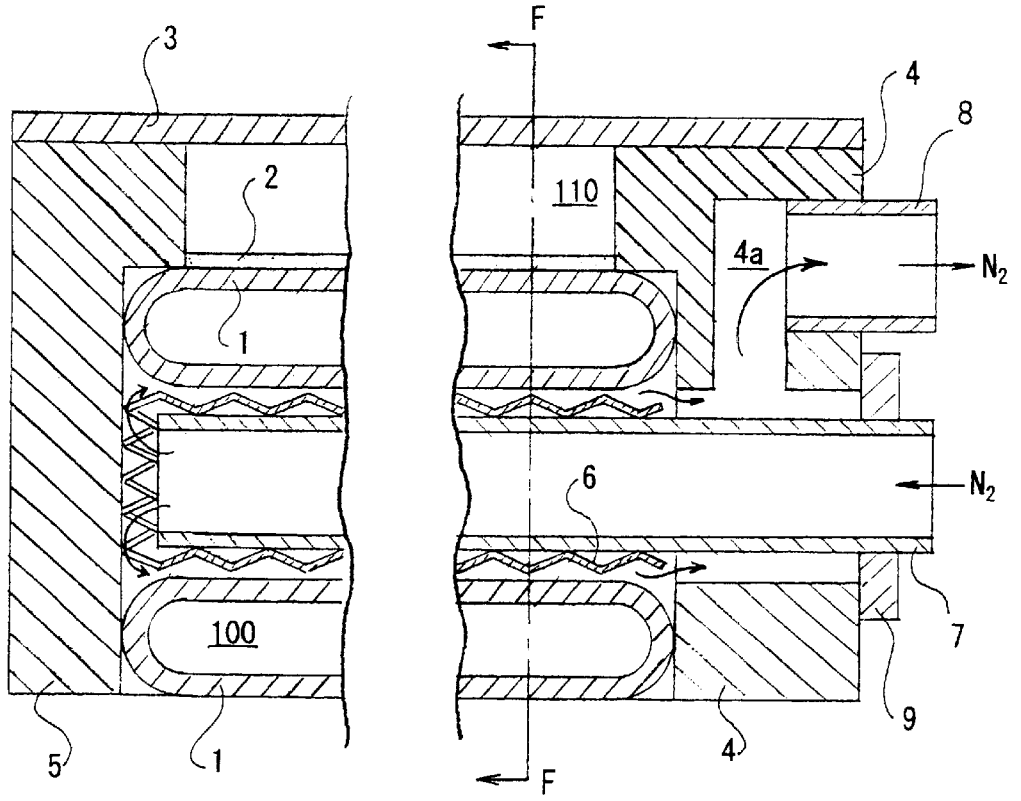
FIG. 15 is a longitudinal sectional view taken along the line D—D of FIG. 9.

FIG. 9 is a bottom view of a dielectric barrier discharge lamp as shown in FIG. 7. FIG. 10 is a front view of a dielectric barrier discharge lamp as shown in FIG. 9. FIG. 11 is a left side view of a dielectric barrier discharge lamp as shown in FIG. 9. FIG. 12 is a right side view of a dielectric barrier discharge lamp as shown in FIG. 9. FIG. 13 is a cross-sectional view (a cross-sectional view taken along the line F—F of FIG. 15) of a dielectric barrier discharge lamp as shown in FIG. 9. FIG. 14 is a longitudinal sectional view (a longitudinal-sectional view taken along the line E—E of FIG. 10) of a dielectric barrier discharge lamp as shown in FIG. 9. FIG. 15 is a longitudinal sectional view taken along the line D—D of FIG. 9. FIG. 9, FIG. 10, FIG. 14 and FIG. 15 are drawn with the central portion in the longitudinal direction (in the axial direction of the discharge container 1) being omitted. The dielectric barrier discharge lamp as shown in FIG. 9 to FIG. 15 is a first embodiment of the dielectric barrier discharge lamp according to the present invention.

In figure, 1 denotes a discharge tube; 1*a* an outer tube of the discharge container 1; 1*b* an inner tube of the discharge container 1; 1*c* the bore of the inner tube 1 *b;* 2 an outside electrode; 3*a* cover; 3*a* a threaded hole; 4, 5 a lamp holder; 4*a* an $N_2$ passage in lamp holder 4; 5*b* a female screw; 6 an internal electrode; 7 an $N_2$ introduction tube; 8 an $N_2$ exhaust tube; 9 a packing; 10 a dielectric barrier discharge lamp; 11 an $N_2$ exhaust gap; 20 an irradiation unit; 21, 22 a side member in irradiation unit; 23 a lower frame in irradiation unit; 24 an upper frame in irradiation unit; 30 a cleaning chamber structure; 31 a base plate forming cleaning structure; 41 a female screw; 50 a tabular light source device formed by arranging five dielectric barrier discharge lamps flatly; 51, 52 a spacer; 60 a tabular light source device formed by arranging three dielectric barrier discharge lamps flatly; 100 a discharge space; 110 an outside electrode cooling gas space; and 200 a cleaning chamber.

The dry cleaning device as shown in FIG. 1 to FIG. 4 uses a dielectric barrier discharge lamp 10*a,* 10*b* as an ultraviolet light source as shown in FIG. 9 to FIG. 15, and has a cleaning chamber structure 30 for accommodating a workpiece 40 to expose the workpiece 40 to the ultraviolet light projected from the ultraviolet light source. The dielectric barrier discharge lamps 10*a* and 10*b* form a tabular light source device. The dielectric barrier discharge lamps 10*a* and 10*b* have quite the same construction. With the perspective side view in FIG. 7, the ultraviolet light source as shown in FIG. 9 to FIG. 15 is expressed, being slightly simplified (the packing as depicted in FIG. 9 to FIG. 15 being omitted in FIG. 7).

With the tabular light source device, the dielectric barrier discharge lamps 10*a* and 10*b* are arranged tabularly; the lamps 10*a* and 10*b* are sandwiched by side members 21 and 22; and the side members 21 and 22, and the lamps 10*a* and 10*b* are integrally held by a lower frame 23 and an upper frame 24. The axes of these dielectric barrier discharge lamps 10*a* and 10*b* are parallel to each other. With the dielectric barrier discharge lamps 10*a* and 10*b,* a part of the ultraviolet light generated in the discharge space 100 by the discharge between the inside electrode 6 and the outside electrode 2 that has reached the outside electrode 2 is reflected at the outside electrode 2. This construction causes the ultraviolet light shining in the discharge space 100 in the dielectric barrier discharge lamp 10*a,* 10*b* to be projected from a half (the lower half in FIG. 1) of the outer tube 1*a*. Thus, the light taking-out window of the dielectric barrier discharge lamp 10*a,* 10*b* is the region of the outer tube 1*a* that is not covered with the outer electrode 2. The light taking-out windows of the dielectric barrier discharge lamps 10*a* and 10*b* are directed toward the same side. These dielectric barrier discharge lamps 10*a* and 10*b* are arranged with the sides of the covers 3 being contacted with each other. Here, the tabular light source device constitutes the irradiation unit 20.

With the cleaning chamber structure 30, the cleaning surface (the top) of a workpiece 40 is located at a distance as small as 3 mm from the light taking-out window, and the ultraviolet light projected from the light taking-out window permeates a mixture of nitrogen ($N_2$) gas and oxygen ($O_2$) gas to the workpiece 40. The mixture of nitrogen ($N_2$) gas and oxygen ($O_2$) gas is equivalent to the above-mentioned medium having a uniform index of refraction.

The dielectric barrier discharge lamps 10*a* and 10*b* are a double-cylinder type dielectric barrier discharge lamp. The double-cylinder type dielectric barrier discharge lamp 10*a,* 10*b* comprises a double-cylinder type discharge container 1 with which a discharge gas, such as xenon gas, is sealed in the space 100 between the transparent outside cylindrical tube 1*a* and inside cylindrical tube 1*b;* an outside electrode 2 which is provided outside the outer tube 1*a* (equivalent to the above-mentioned outside cylindrical tube); and an inside electrode 6 disposed coaxially in the bore of the inner tube 1*b* (equivalent to the above-mentioned inside cylindrical tube).

In the bore of the inner tube 1*b,* a gas introduction tube 7 is inserted. The gas introduction tube 7 has an outside diameter smaller than that of the bore of the inner tube 1*b*. Thus, between the O.D. surface of the gas introduction tube 7 and the I.D. surface of the inner tube 1*b,* a clearance is provided. The bore of the inner tube 1*b* is blocked by the lamp holder 4 at one end, and by the lamp holder 5 at the other end. The lamp holder 4 is equivalent to the above-mentioned one-end-side end- structure, while the lamp holder 5 is equivalent to the above-mentioned other-end-side end- structure.

The lamp holder 5 seals the opening of said inner tube on the other end side, and thereby, causes the nitrogen ($N_2$) gas introduced from the opening (the inlet as shown with an arrow $N_2$ in FIG. 14 and FIG. 15) at one end of the gas introduction tube 7 and discharged from the opening (the left end in FIG. 14 and FIG. 15) at the other end of the gas introduction tube 7 to be turned back on the other end side and introduced into said clearance.

The outside electrode 2 is covered with a cover 3. The cover 3 prevents the outside electrode 2 from being exposed to the ozone generated by the ultraviolet light radiated from the discharge container 1. The outside electrode 2 is formed in a trough-like shape, the inner surface being tightly contacted with the O.D. surface of the outer tube 1*a*. The inner surface of the outside electrode 2 forms a circular arc, such as a semicircle, in the plane orthogonalizing the axis of the outer tube 1*a,* and provides a mirror surface which reflects the ultraviolet light. This mirror surface is coated with $MgF_2$ or the like. The inside electrode is disposed in the clearance between the gas introduction tube 7 and the inner tube 1*b,* being formed in a net-like shape which allows the nitrogen ($N_2$) gas to flow along the axial direction in the clearance.

Because the half of the O.D. surface of the outer tube 1*a* is tightly contacted with the outside electrode 2, the ultraviolet light is not projected from the region covered with the outside electrode 2, but reflected thereat. On the other hand, the remaining half of the O.D. surface of the outer tube 1*a* corresponds to the aperture of the outside electrode 2, being not provided with the outside electrode 2. Thus, the region corresponding to the aperture of the outside electrode 2 provides a light taking-out window of the discharge container 1.

The discharge container 1 is made of quartz glass, having an outside diameter of 25 mm, an inside diameter (the inside diameter of the inner tube 1*b*) of 12 mm, and a length of 288 mm. The outside electrode 2, the $N_2$ introduction tube 7, the $N_2$ exhaust tube 8 and the cover 3 are made of aluminum. The lamp holder 4, 5 is made of plastic, being partially provided with a coating for resistance to ultraviolet light and ozone.

With the dry cleaning device as shown in FIG. 1 to FIG. 4, a gas mixture of nitrogen ($N_2$) gas and oxygen ($O_2$) gas is caused to flow between the dielectric barrier discharge lamp 10*a,* 10*b* and the workpiece 40, and the ultraviolet light from the dielectric barrier discharge lamp 10*a,* 10*b* is directly projected onto the workpiece 40. When the dielectric barrier discharge lamp as shown in FIG. 11 in the Patent Publication No. 2705023 is used with the above-mentioned dry cleaning device as shown in FIG. 2 in the same Patent Publication as an ultraviolet light source (100), a window made of quartz glass is interposed between the ultraviolet light source (100) and the workpiece (9). Contrarily, with the dry cleaning device which is the present embodiment, no quartz glass window is interposed, therefore, no permeation attenuation and reflection at the quartz glass window are caused, and the diffusion of the ultraviolet light due to the distance from the dielectric barrier discharge lamp to the quartz glass window is at a minimum. In other words, with the dry cleaning device of the present embodiment, the index of refraction of the ultraviolet light permeating medium between the ultraviolet light source and the workpiece is uniform, no reflection at the ultraviolet light permeating medium is caused, and the propagation distance of the ultraviolet light permeating that medium can be reduced to as small as a few mm. In addition, while the electrode of a net construction offers an opening ratio loss of a few percent, the outside electrode 2 forming a reflecting mirror offers no opening ratio loss. The intensity of the ultraviolet light projected from the dielectric barrier discharge lamp 10*a,* 10*b* varies depending upon the region of the workpiece 40. The ultraviolet light on the workpiece 40 is intense just under the dielectric barrier discharge lamp 10*a,* 10*b,* and weak in the region between both lamps. Even if the intensity of the ultraviolet light on the workpiece 40 is not uniform, placing the workpiece 40 on a conveyor or rocking it allows the cleanliness of the workpiece 40 over the entire region to be uniform to such a degree that there is no obstacle for practical use.

With the dry cleaning device as shown in FIG. 5 to FIG. 15, cooling is provided by causing the nitrogen ($N_2$) gas to flow through the inner tube of the discharge container 1. The path through which the nitrogen ($N_2$) gas flows is shown with arrows in FIG. 14 and FIG. 15. The packing 9 prevents the nitrogen ($N_2$) gas from leaking from the clearance between the lamp holder 4 and the $N_2$ introduction tube 7. The lamp holder 4 is provided with an $N_2$ passage 4*a*. The $N_2$ passage 4*a* connects the clearance between the I.D. surface of the inner tube 1*b* and the O.D. surface of the $N_2$ introduction tube 7 to the $N_2$ exhaust tube 8. Delivery of the $N_2$ gas can be easily carried out by using the pressure of a nitrogen gas cylinder or an air pump.

The means of preventing the outside electrode 2 from being exposed to the ozone is a mere cover 3, which provides an extremely simple construction. The construction with which the outside electrode 2 is tightly contacted with the outer tube 1*a* simplifies the design to insulate the outside electrode 2 from ozone. Because the outside electrode 2 also serves as a means of reflecting the ultraviolet light, there is no need for a special light reflection means to direct the ultraviolet light toward the workpiece 40. This also contributes to simplification of the construction of the dielectric barrier discharge lamp.

FIG. 16 to FIG. 22 show a second embodiment of the dielectric barrier discharge lam according to the present invention. FIG. 16 to FIG. 22 correspond to FIG. 9 to FIG. 15, respectively.

Figure 16:
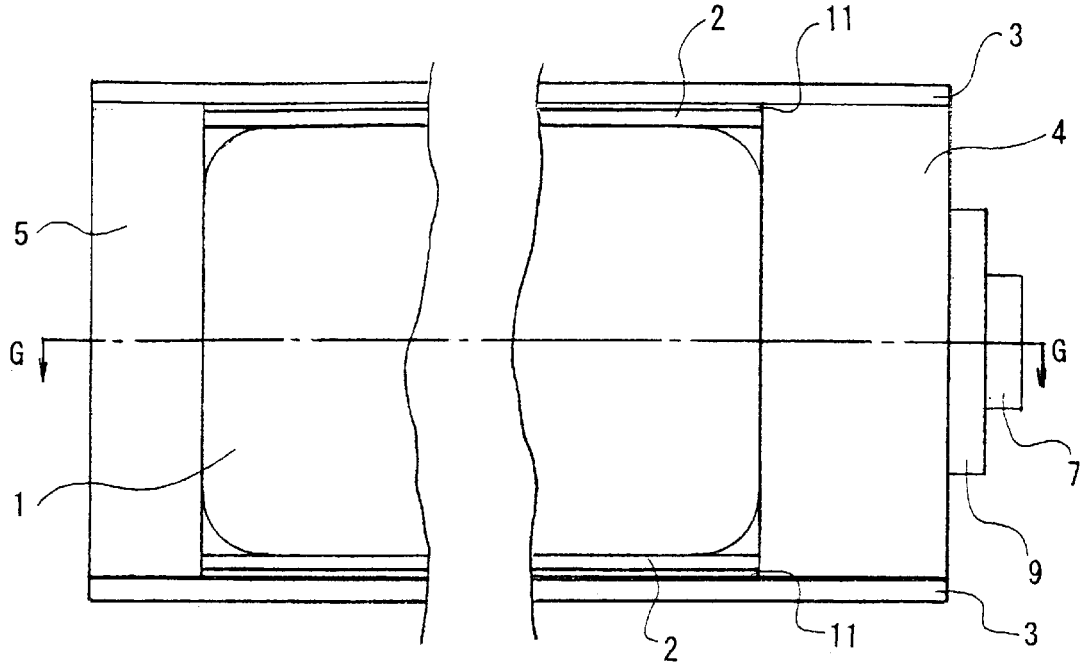
FIG. 16 is a bottom view of a dielectric barrier discharge lamp which is a second embodiment of the present invention.
Figure 17:
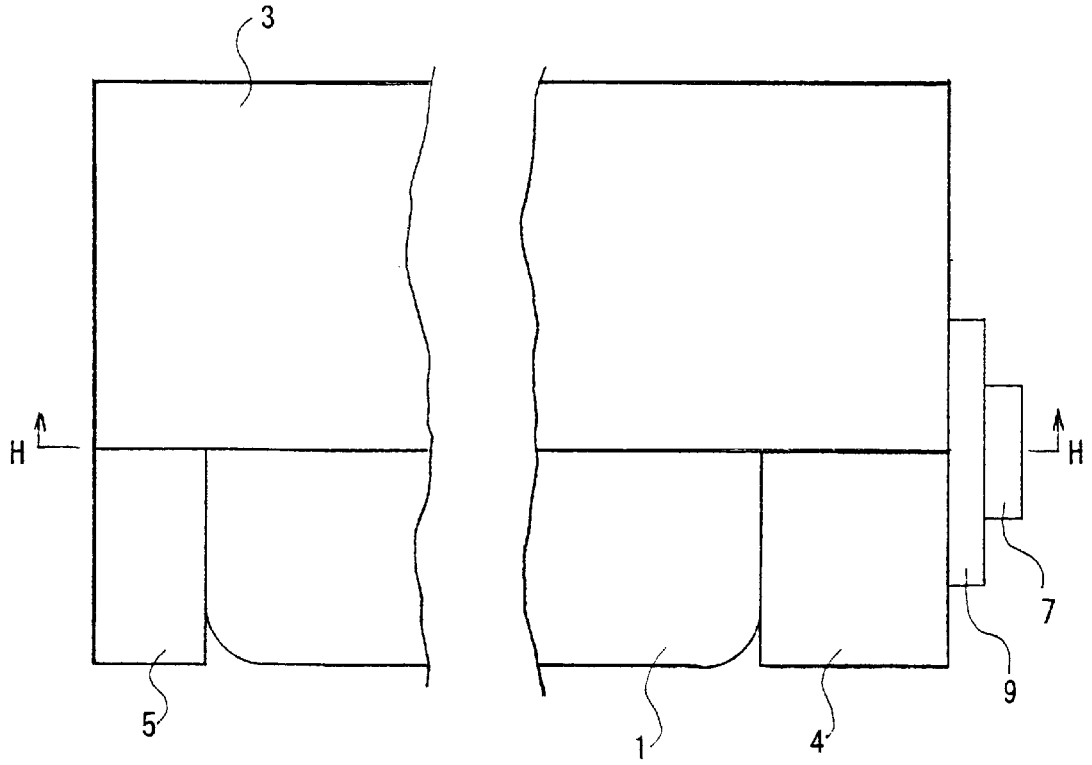
FIG. 17 is a front view of a dielectric barrier discharge lamp as shown in FIG. 16.
Figure 18:
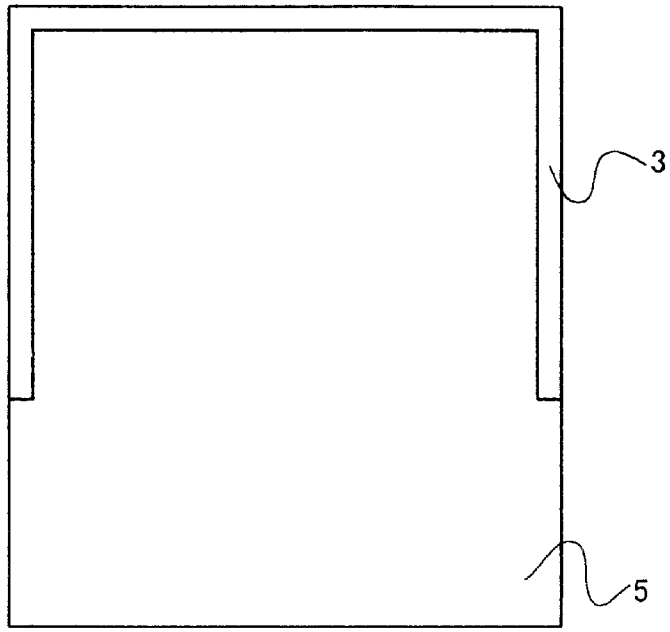
FIG. 18 is a left side view of a dielectric barrier discharge lamp as shown in FIG. 16.
Figure 19:
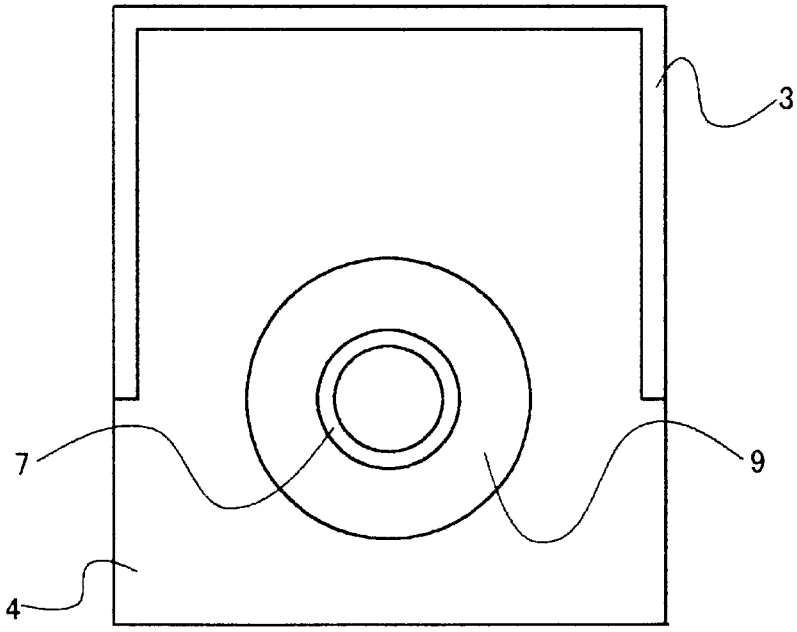
FIG. 19 is a right side view of a dielectric barrier discharge lamp as shown in FIG. 16.
Figure 20:
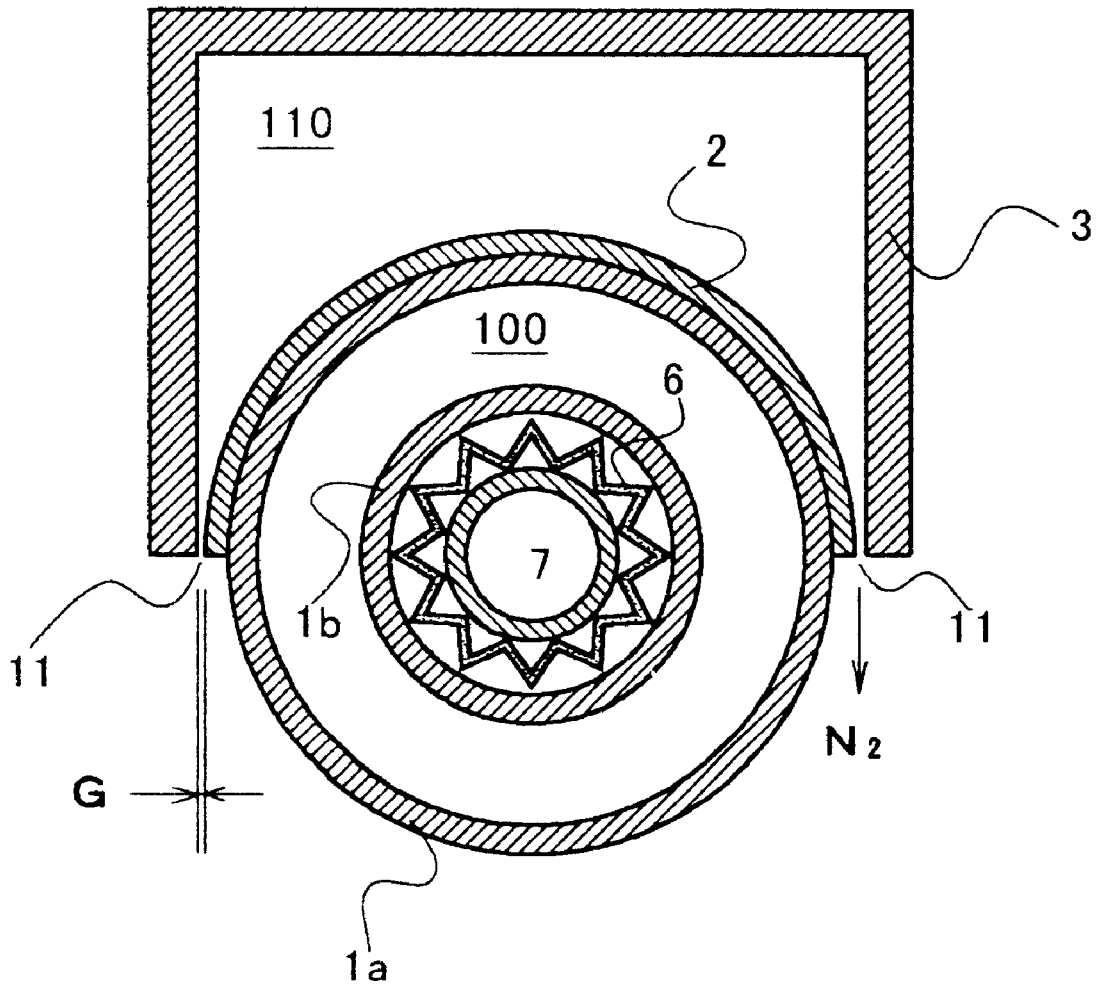
FIG. 20 is a cross-sectional view (a cross-sectional view taken along the line J—J of FIG. 22) of a dielectric barrier discharge lamp as shown in FIG. 16.
Figure 21:
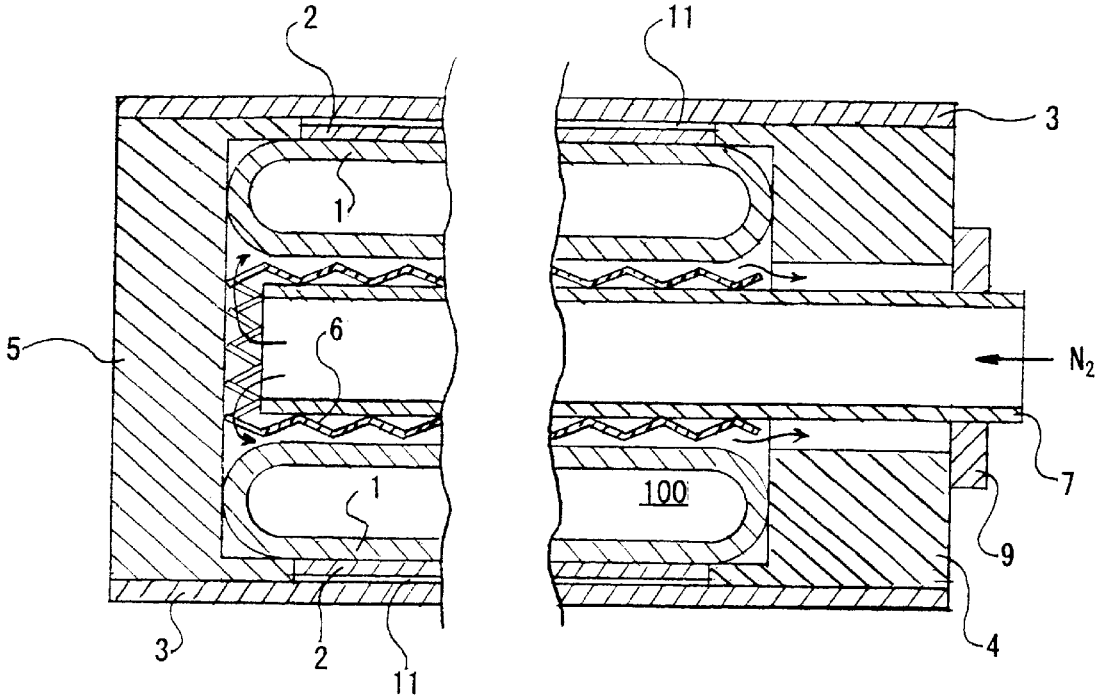
FIG. 21 is a longitudinal sectional view (a longitudinal-sectional view taken along the line H—H of FIG. 17) of a dielectric barrier discharge lamp as shown in FIG. 16.
Figure 22:
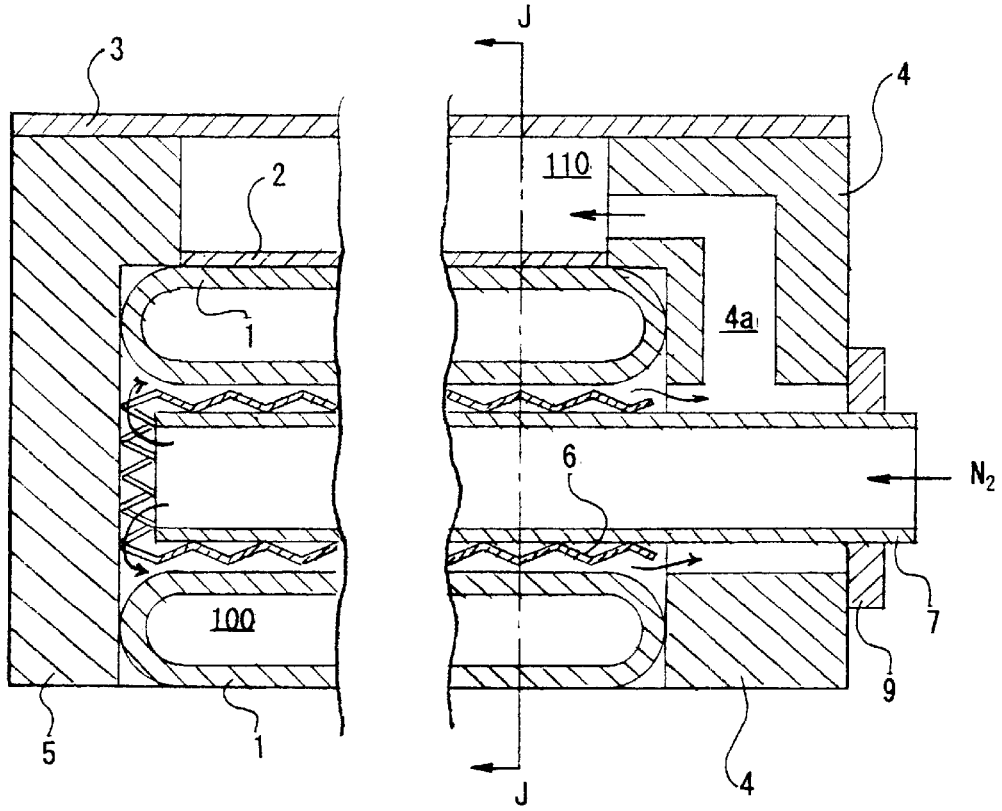
FIG. 22 is a longitudinal sectional view taken along the line G—G of FIG. 16.

FIG. 16 is a bottom view of a dielectric barrier discharge lamp which is the second embodiment of the present invention. FIG. 17 is a front view of a dielectric barrier discharge lamp as shown in FIG. 16. FIG. 18 is a left side view of a dielectric barrier discharge lamp as shown in FIG. 16. FIG. 19 is a right side view of a dielectric barrier discharge lamp as shown in FIG. 16. FIG. 20 is a cross-sectional view (a cross-sectional view taken along the line J—J of FIG. 22) of a dielectric barrier discharge lamp as shown in FIG. 16. FIG. 21 is a longitudinal sectional view (a longitudinal-sectional view taken along the line H—H of FIG. 17) of a dielectric barrier discharge lamp as shown in FIG. 16. FIG. 22 is a longitudinal sectional view taken along the line G—G of FIG. 16. FIG. 16, FIG. 17, FIG. 21 and FIG. 22 are drawn with the central portion in the longitudinal direction (in the axial direction of the discharge container 1) being omitted.

With this second embodiment, the nitrogen ($N_2$) gas passage 4*a* in the lamp holder 4 connects the clearance between the I.D. surface of the inner tube 1*b* and the O.D. surface of the $N_2$ introduction tube 7 to the outside electrode cooling gas space 110. The lamp holder 4 seals the opening of the inner tube of the discharge container 1 so that the nitrogen ($N_2$) gas discharged from said clearance on said one end side is introduced into the outside electrode cooling gas space 110.

Further, with the second embodiment, an $N_2$ exhaust gap 11 (equivalent to the above-mentioned gap) for discharging the nitrogen ($N_2$) gas passed through the outside electrode cooling gas space 110 is formed between the outer surface of the outside electrode 2 and the cover 3. More specifically, the $N_2$ exhaust gap 11 is formed between the edge along the axial direction of the outside electrode 2 and the edge of the Π-shaped opening of the cover 3. The "axial direction" mentioned here refers to the direction along the axis of the discharge container 1.

When this dielectric barrier discharge lamp which is the second embodiment is loaded in the dry cleaning device as shown in FIG. 1 as a dielectric barrier discharge lamp 10*a*, 10*b*, the $N_2$ exhaust gap 11 is opened into the cleaning chamber 200. Thus, the nitrogen ($N_2$) gas used for cooling the dielectric barrier discharge lamp 10*a*, 10*b* is supplied for the cleaning chamber 200 to be used for adjusting the concentration of nitrogen ($N_2$) gas in the cleaning chamber 200. If the quantity of nitrogen ($N_2$) gas supplied for the cleaning chamber 200 is increased, the concentration of oxygen ($O_2$) gas in the cleaning chamber 200 is lowered, resulting in reduction of the quantity of ozone generated by the ultraviolet light radiated from the dielectric barrier discharge lamp 10*a*, 10*b* acting on the oxygen ($O_2$) gas in the cleaning chamber 200. The workpiece 40 is cleaned by both ultraviolet light and ozone, and the degrees of action of both can be adjusted by changing the quantity of nitrogen ($N_2$) gas supplied for the cleaning chamber 200.

With the dielectric barrier discharge lamp of the second embodiment, an effect of that the nitrogen ($N_2$) gas for cooling can be supplied for the cleaning chamber 200 is added to the same effects as those with the dielectric barrier discharge lamp of the first embodiment as stated above. With this configuration, the concentration of nitrogen ($N_2$) gas in the cleaning chamber 200 can be adjusted by changing the quantity of nitrogen ($N_2$) gas supplied for cooling.

With the dry cleaning device which uses this dielectric barrier discharge lamp of the second embodiment as an ultraviolet light source, the cleaning chamber can be filled only with nitrogen ($N_2$) gas for purging the cleaning chamber of oxygen ($O_2$) gas, and by doing this, the ultraviolet light from the dielectric barrier discharge lamp can be projected onto the workpiece with practically no attenuation being caused on its way. With this construction, the attenuation of the ultraviolet light is low, therefore, if the distance between the dielectric barrier discharge lamp and the workpiece is large (for example, a few tens centimeters), a sufficient capacity of cleaning the workpiece is provided. By providing a sufficiently large distance between the dielectric barrier discharge lamp and the workpiece, the uniformity of density of ultraviolet light on the surface of the workpiece can be improved.

Figure 8:
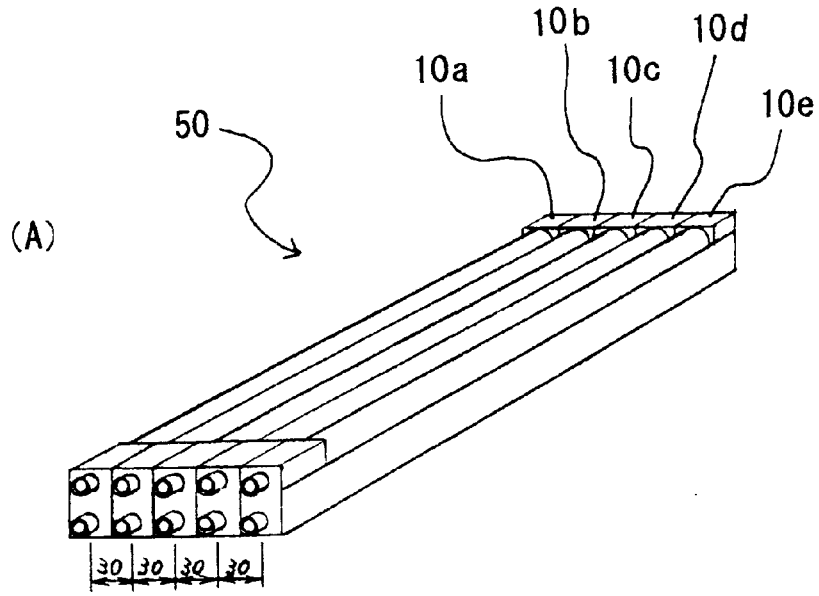
FIG. 8(A) is a perspective side view of a tabular light source device formed by arranging five dielectric barrier discharge lamps side-by-side as shown in FIG. 7.
FIG. 8(B) is a perspective side view of a tabular light source device formed by arranging three dielectric barrier discharge lamps side-by-side as shown in FIG. 7.
Figure 8:
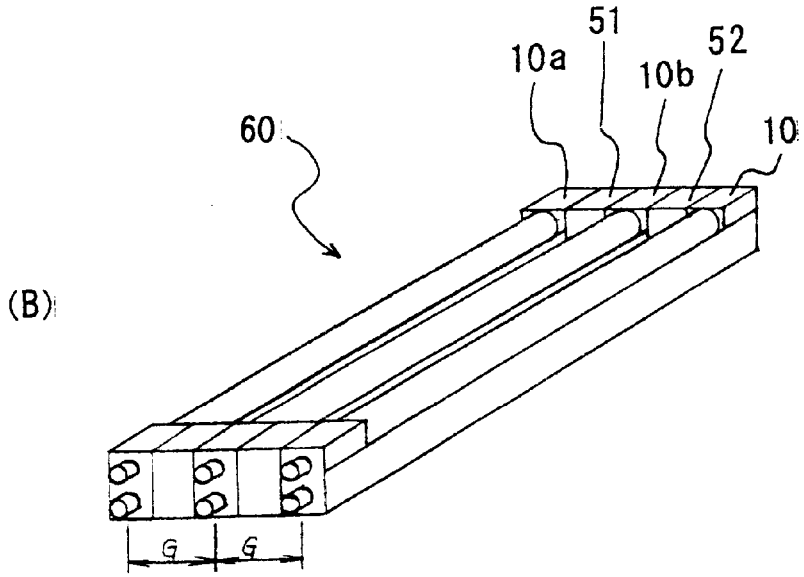

With the above-stated embodiments, the dielectric barrier discharge lamps 10*a* and 10*b* are arranged tabularly to form a tabular light source device. By tabularly arranging a number of dielectric barrier discharge lamps in tight contact with one another, a tabular light source device having a large area can be configured. FIG. 8(A) shows a tabular light source device formed by flatly arranging five dielectric barrier discharge lamps in tight contact with one another, and FIG. 8(B) shows a tabular light source device formed by using three dielectric barrier discharge lamps and interposing a spacer 51, 52 between dielectric barrier discharge lamps to widen the area. The intensity of the ultraviolet light obtained with the tabular light source device as shown in FIG. 8 (B) is lower than that with the device as shown in FIG. 8(A).

Hereinbefore, the embodiments have been mentioned to specifically describe the present invention, however, the present invention is, of course, not limited to these embodiments, and various other configurations can be provided. For example, with the dry cleaning device of the embodiments, the ultraviolet light is projected from above the workpiece, however, by disposing the dielectric barrier discharge lamps on the right and left sides of and in front and rear of the workpiece, the top, right and left sides, and front and back of the workpiece can be cleaned.

With the dry cleaning device of the above stated embodiment, the distance between the light taking-out window of the dielectric barrier discharge lamp and the workpiece has been specified to be a few mm. However, with the present invention, no quartz glass which partitions the dielectric barrier discharge lamp and the cleaning chamber is used, and therefore the distance can be reduced to as small as 1 mm.

Hereinbefore, a cleaning device which is well suited for use in the cleaning process in which the organic substances on the surface of a semiconductor wafer or the like is decomposed and removed has been described, however, the configuration of the present invention can be applied to a surface modification device as it is. The surface modification is a treatment in which the surface of a plastic film or the like is exposed to ultraviolet light or ozone for causing the OH group to come to the surface. A substance which has been subjected to the surface modification treatment has a number of OH group on the surface, and therefore it is easy to be printed by means of water based ink. Conventionally, the surface modification has generally been performed by use of a mercury lamp. But, the calorific value of the mercury lamp is high, which means that the mercury lamp is not suitable for surface treatment of plastic films. The dielectric barrier discharge lamp has a calorific value substantially lower than that of the mercury lamp. The cleaning device according to the present invention is configured to use a dielectric barrier discharge lamp as the ultraviolet light source, which means that it is well suited for surface treatment of plastic films.

As specifically described above by mentioning the embodiments, the present invention can offer a dielectric barrier discharge lamp which is simple in construction while being provided with both cooling means and electrode oxidation prevention means, and can direct the ultraviolet light toward a definite direction with no need for a special construction for reflection of ultraviolet light. The present invention can also offer a dry cleaning device using a dielectric barrier discharge lamp as the ultraviolet light source with which the electrode of the dielectric barrier discharge lamp can be insulated from ozone without using an ultraviolet light taking-out window made of quartz glass.

What is claimed is:

1. A double-cylinder type dielectric barrier discharge lamp which has a double-cylinder type discharge container which seals discharge gas, such as xenon gas, in the space between a transparent outside cylindrical tube and inside cylindrical tube; an outside electrode provided in the vicinity of the outside of the outside cylindrical tube; and an inside electrode which is coaxially disposed in the bore of the inside cylindrical tube; comprising:

a gas introduction tube which has an outside diameter smaller than the diameter of the bore of said inside cylindrical tube, providing a clearance between it and the bore, and is inserted into the bore;

an other-end-side end-structure which seals the opening of said bore on the other end side so that gas, such as, nitrogen gas which is introduced from the opening at one end of said gas introduction tube and discharged from the opening at the other end of the gas introduction tube is turned back on the other end side to be introduced into said clearance; and a cover which covers said outside electrode, and prevents the outside electrode from being exposed to the ozone generated by the ultraviolet light radiated from said discharge container;

wherein said outside electrode is formed in a trough-like shape, and is disposed with the inner surface being tightly contacted with the O.D. surface of said outside cylindrical tube, said inner surface forms a circular arc, such as a semicircle, in the plane orthogonalizing the axis of said outside cylindrical tube, and provides a mirror surface which reflects the light, said inside electrode is disposed in the clearance between said gas introduction tube and said inside cylindrical tube, being formed in a net-like shape which allows said gas to flow along the axial direction in the clearance, and said outside cylindrical tube provides a light taking-out window of said discharge container in the region corresponding to the aperture of said outside electrode.

2. A dielectric barrier discharge lamp according to claim 1, wherein said cover is formed in the shape which forms a cooling gas space for passing gas between the cover and said outside electrode for cooling the outside electrode, an one-end-side end-structure which seals the opening of said bore on said one end side so that said gas discharged from said clearance on said one end side is introduced into said cooling gas space is provided, and a gap for discharging said gas passed through said cooling gas space is formed between the O.D. surface of said outside cylindrical tube or the outer surface of said outside electrode and said cover.

3. A dielectric barrier discharge lamp according to claim 2, wherein said inner surface of said outside electrode forms a semicircle in the plane orthogonalizing the axis of the outside cylindrical tube, the sectional shape of said cover in the plane orthogonalizing said axis is of letter-Π, and said gap is formed between the edge along the direction of said axis of said outside electrode and the edge of the Π-shaped opening of said cover.

4. A tabular light source device with which a plurality of dielectric barrier discharge lamps according to claim 3 are tabularly arranged, wherein the axes of the plurality of dielectric barrier discharge lamps are parallel to one another, said light taking-out windows in the plurality of dielectric barrier discharge lamps are directed toward the same side, and the sides of said covers are contacted to one another or a spacer is interposed between covers.

5. A dry cleaning device according to claim 3, wherein, with said cleaning chamber structure, the workpiece is exposed to at least either of the ultraviolet light projected from said ultraviolet light source and the ozone generated by the ultraviolet light acting on the oxygen gas, and said ultraviolet light projected from said light taking-out window reaches said workpiece through a medium having a uniform index of refraction.

6. A tabular light source device with which a plurality of dielectric barrier discharge lamps according to claim 2 are tabularly arranged, wherein the axes of the plurality of dielectric barrier discharge lamps are parallel to one another, said light taking-out windows in the plurality of dielectric barrier discharge lamps are directed toward the same side, and the sides of said covers are contacted to one another or a spacer is interposed between covers.

7. A dry cleaning device according to claim 2, wherein, with said cleaning chamber structure, the workpiece is exposed to at least either of the ultraviolet light projected from said ultraviolet light source and the ozone generated by the ultraviolet light acting on the oxygen gas, and said ultraviolet light projected from said light taking-out window reaches said workpiece through a medium having a uniform index of refraction.

8. A tabular light source device with which a plurality of dielectric barrier discharge lamps according to claim 1 are tabularly arranged, wherein the axes of the plurality of dielectric barrier discharge lamps are parallel to one another, said light taking-out windows in the plurality of dielectric barrier discharge lamps are directed toward the same side, and the sides of said covers are contacted to one another or a spacer is interposed between covers.

9. A tabular light source device according to claim 8, wherein, with said cleaning chamber structure, the workpiece is exposed to at least either of the ultraviolet light projected from said ultraviolet light source and the ozone generated by the ultraviolet light acting on the oxygen gas, and said ultraviolet light projected from said light taking-out window reaches said workpiece through a medium having a uniform index of refraction.

10. A dry cleaning device according to claim 1, wherein, with said cleaning chamber structure, the workpiece is exposed to at least either of the ultraviolet light projected from said ultraviolet light source and the ozone generated by the ultraviolet light acting on the oxygen gas, and said ultraviolet light projected from said light taking-out window reaches said workpiece through a medium having a uniform index of refraction.

11. A dry cleaning device according to claim 10, wherein, with said cleaning chamber structure, the cleaning surface of said workpiece is located at a distance as small as a few mm from said light taking-out window.

12. A dry cleaning device, having an ultraviolet light source which comprises a tabular light source device, and a cleaning chamber structure for accommodating a workpiece, wherein, with said cleaning chamber structure, the workpiece is exposed to at least either of the ultraviolet light projected from said ultraviolet light source and the ozone generated by the ultraviolet light acting on the oxygen gas, said tabular light source device comprises a plurality of dielectric barrier discharge lamps according to claim 3 which are tabularly arranged side by side with the sides of said covers being contacted to one another or a spacer being interposed between covers, and said light taking-out windows in the plurality of dielectric barrier discharge lamps are directed toward the same side, said gap is opened into the cleaning chamber of said cleaning chamber structure, and said ultraviolet light projected from said light taking-out window reaches said workpiece through a medium having a uniform index of refraction.

13. A dry cleaning device according to claim 12, wherein, with said cleaning chamber structure, the cleaning surface of said workpiece is located at a distance as small as a few mm from said light taking-out window.

* * * * *